US005650768A

United States Patent [19]

Eswaran

[11] Patent Number: 5,650,768

[45] Date of Patent: Jul. 22, 1997

[54] BAGGAGE CLAIMING METHOD AND APPARATUS

[76] Inventor: Kapali P. Eswaran, 1070 Abingdon La., Alpharetta, Ga. 30202

[21] Appl. No.: 610,491

[22] Filed: Mar. 4, 1996

[51] Int. Cl.[6] ..... G08B 13/22

[52] U.S. Cl. ..... 340/572; 340/522; 340/540; 340/551; 340/568

[58] Field of Search ..... 340/568, 572, 340/551, 522, 540

[56] References Cited

U.S. PATENT DOCUMENTS 3,832,530 8/1974 Reitboeck et al. ..... 340/572
5,260,690 11/1993 Mann et al. ..... 340/572
5,376,921 12/1994 Trikilis ..... 340/551
5,406,263 4/1995 Tuttle ..... 340/572

*Primary Examiner*—Glen Swann

[57] ABSTRACT

An automatic baggage claiming apparatus for use in an airport, train station, or bus station controls removal of baggage from a secured area. The present invention scans a baggage tag and a claim check in order to obtain the baggage tag identifier and the claim check identifier, respectively. The present invention compares the tag identifiers and provides a signal if the tag identifiers are the same or an alert signal if the tag identifiers are not the same. If the signal is provided, a passenger is permitted to exit the secured area with the checked baggage. However, if the alert signal is provided, the passenger is prevented from exiting the secured area with the baggage.

18 Claims, 2 Drawing Sheets

BAGGAGE CLAIMING METHOD AND APPARATUS

TECHNICAL FIELD

The present invention relates to automatic baggage claiming devices and, more particularly, is an apparatus for controlling removal of baggage from a secured area which uses scanners for matching claim checks with baggage tags, so as to permit a passenger to exit with properly matched baggage upon obtaining clearance to exit through an electrically controlled lock.

BACKGROUND OF THE INVENTION

Upon arrival at an airport, train station, or bus station, one task many passengers desire to immediately resolve is that of checking baggage. A passenger gives an attendant his baggage and the attendant attaches a baggage tag to each piece of baggage. The attendant then gives the passenger a claim check for each bag that the attendant checks. The claim check contains at least some of the same information, such as routing, tag identifier, and other relevant data, as the baggage tag. The claim check is retained by the passenger so that the passenger may use the claim check to reclaim his baggage upon arrival at his final destination.

Upon arrival at the passenger's final destination, the passenger encounters a task that sometimes becomes an ordeal, that of reclaiming his baggage. Once the passenger reaches the baggage claim terminal to retrieve his baggage, he must identify his baggage among many bags, some of which look alike. The prudent passenger looks at the baggage tag of each bag he selects and compares the baggage tag to his claim check. If the tags do not match, the passenger continues to search for his bag with the matching tag. However, if the tags match, the passenger must then find an agent who is responsible for verifying that the passenger's claim check and baggage tag match before the passenger may leave the baggage claim area with the baggage.

Oftentimes, there are too few agents staffed to handle the large influx of passengers and baggage to arrive at various times throughout the day and night. In other cases, there are no agents on duty to check bags, especially when an airplane, bus, or train arrives at late or odd hours. The problem of under-staffing or lack of staffing increases the likelihood that a passenger who is in a hurry will be unnecessarily delayed or that the wrong bag will be mistakenly chosen by a not so prudent passenger, respectively.

Therefore, there is a need for an automatic baggage claiming apparatus which operates continuously and can handle checking any number of bags.

Finally, there are, unfortunately, a few people in our society who enjoy taking advantage of the weaknesses in our processes and in turn, hurt us through thievery. When agents are not present or due to under-staffing, are bombarded by too many passengers needing bags checked, the opportunity for an individual to leave the baggage claim area with someone else's baggage increases. In the past, there has been no measure taken to prevent or curtail this problem.

Therefore, there is a need for an automatic baggage claiming apparatus which utilizes controlled locks for controlling all exits from the baggage claim area.

SUMMARY OF THE INVENTION

The present invention is an automatic baggage claiming apparatus which is useful for controlling the removal of baggage from a secured area. The present invention allows a passenger to place a claim check and baggage tag under a scanner, which verifies whether the tags match. If the tags match, a signal indicates to the passenger that he may exit through an exit-gate with the checked baggage. However, if the tags do not match an audible alarm sounds and/or a visible indicator is actuated indicating to the passenger and an airline agent that the tags do not match in which case the passenger and baggage may exit through another route where the agent is.

Accordingly, it is an object of the present invention to provide an automatic baggage claiming apparatus which can be used where it is required to verify baggage ownership before the removal of the baggage is permitted by showing a claim check that corresponds to a baggage tag which is connected to the baggage.

It is another object of the present invention to provide an automatic baggage claiming apparatus which uses multiple scanners for scanning a baggage tag passed through the scanner's field of view without removing the baggage tag from the bag in order to obtain the baggage tag identifier.

Other objects, features, and advantages of the present invention will become apparent upon reading the following description of a preferred embodiment, when taken in conjunction with the drawings and the claims.

DETAILED DESCRIPTION OF THE PREFERRED EMBODIMENT

Figure 1:
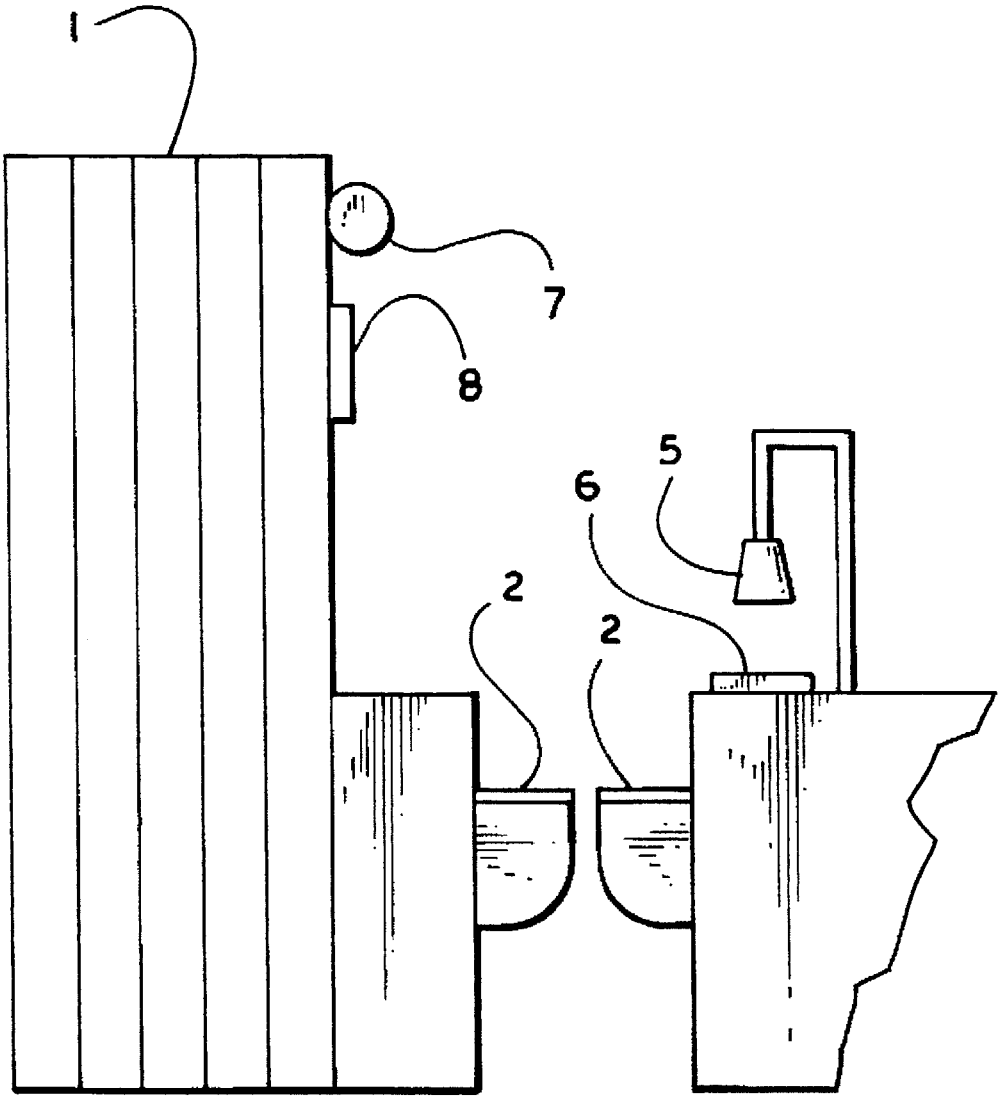
FIG. 1 is an illustration of the preferred environment of the present invention.

Referring to FIG. 1, the preferred environment of the present invention is shown. A baggage claim terminal is enclosed by a gate 1 and at an exit point, is secured by an electrically controlled lock 2. Also, a light 7 and an alarm 8 are located near the exit point. The light 7 and the alarm 8 serve as informational devices indicating that a signal has been transmitted, respectively. A scanner 5 is positioned near the electrically controlled lock 2. A passenger first picks up his baggage and removes baggage tags from the baggage. The passenger, then, places a claim check (not shown) and a baggage tag (not shown) in a field of view 6 of the scanner 5. The scanner 5 scans the claim check in order to obtain a claim check identifier. The scanner 5 then scans the baggage tag in order to obtain a baggage tag identifier. If the tag identifiers match, the light 7 turns on and the electrically controlled lock 2 shifts to an unlocked position allowing the passenger to exit with the checked baggage. However, if the tag identifiers do not match, the alarm 8 sounds informing the passenger and an agent that the tag identifiers do not match. Meanwhile, the electrically controlled lock 2 remains in a locked position, thereby preventing the passenger from exiting the baggage claim area. The passenger and the baggage may be allowed to exit through a different path where an agent may provide assistance.

Figure 2:
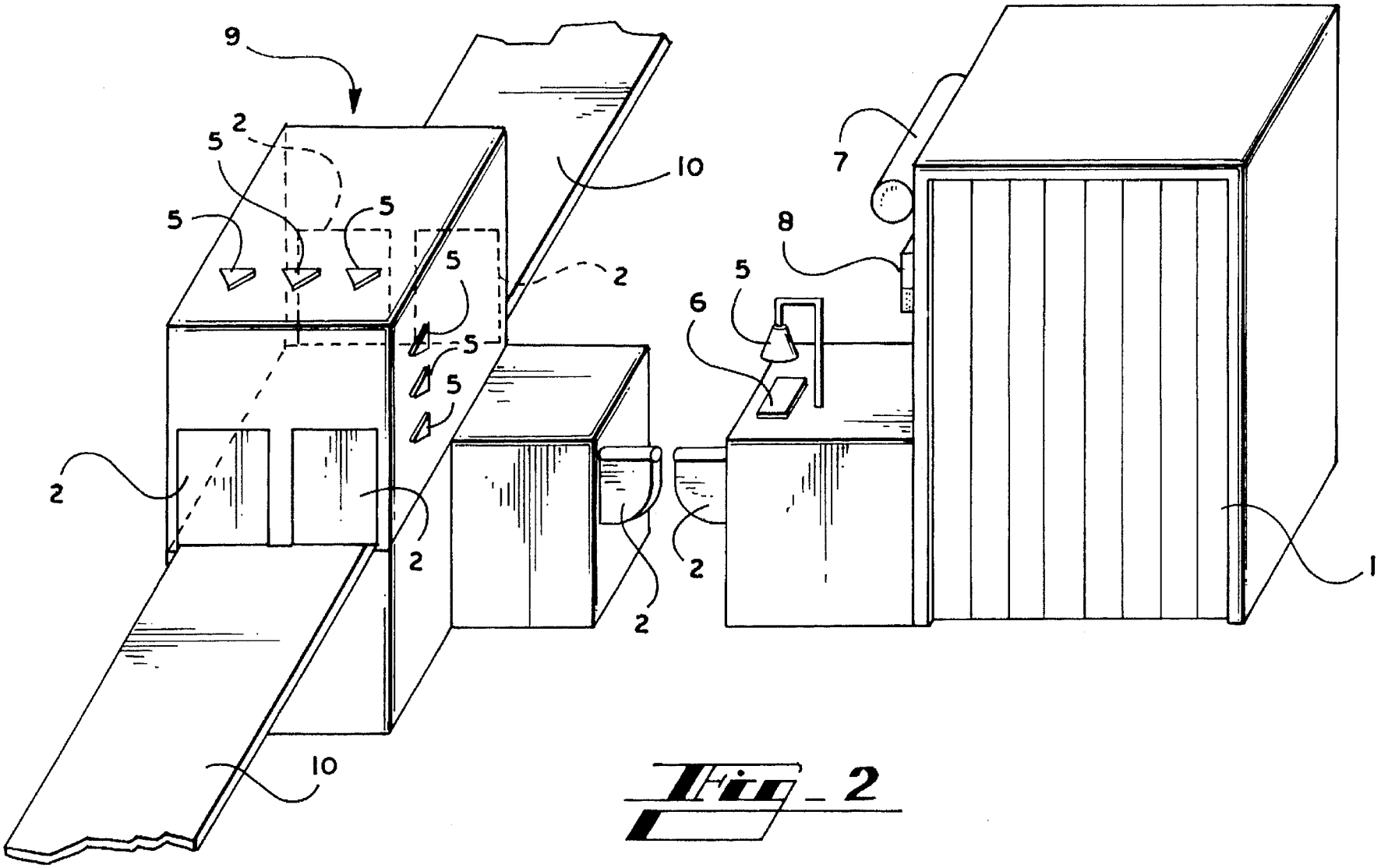
FIG. 2 is an illustration of the alternative environment of the present invention.

An alternative environment, as shown in FIG. 2, consists of several scanners 5, two electrically controlled locks 2, a light 7, an alarm 8, a conveyor belt for baggage 10 and a baggage scanning station 9. One electrically controlled lock 2 is designed to allow only passengers to exit a baggage claim area. The other electrically controlled lock 2 is designed to allow only baggage to exit the baggage claim area.

The baggage claiming station 9 consists of several scanners 5, the conveyor belt 10, and one electrically controlled lock 2. When a passenger selects his baggage, which has a baggage tag attached, the passenger places the baggage on the conveyor belt 10. The passenger proceeds to the electrically controlled lock 2 and places his claim check in the field of view 6 of the scanner 5. Meanwhile, the baggage that was placed on the conveyor belt 10 moves into the baggage scanning station 9.

Since baggage is designed in many shapes and sizes, the location of the baggage tag may vary. As a result, several scanners 5 are placed inside the baggage claiming station 9 so that the baggage tag can be scanned from various angles and the scanned images from all of the scanners are composed to get proper information which is inputted for comparison. Another input for comparison is from scanner 5 (passenger's claim tag). The comparison process compares the inputs and determines if there is a match. If there is a proper match, the light 7 turns on. The light 7 indicates to the passenger that he has permission to proceed. Both of the electrically controlled locks 2 shift to an unlocked position allowing the baggage to pass and allowing the passenger to exit so that he can retrieve the baggage from the conveyor belt 10. After the passenger has made a safe exit and all of the checked baggage has passed through the electrically controlled lock 2 located in the baggage claiming station 9, both electrically controlled locks 2 shift to a locked position so that the next passenger may begin the process as describe above.

However, if the comparison indicates that there is no match, the alarm 8 sounds. The alarm 8 indicates to the passenger and an airline agent that the tags do not match or that there is some other problem with the tags. The passenger and the baggage may be allowed to exit through a different path where an agent may provide assistance.

A passenger may check in a set of countable number of baggages (meaning that the set contains a finite number of baggage pieces, say N). The passenger may be given N separate tags or may be given a single tag containing both the starting identifier and the number N encoded on the tag. The baggages usually will have separate tags since the tags have routing information in addition to the identifier information. In the preferred embodiment 1, when the passenger places the claim tag(s) and baggage tags in the field of view of the scanner, the comparator determines if there is a mapping from the set of baggage tag identifiers to the set of claim tag identifiers. By mapping, it is meant that every baggage tag identifier has one corresponding claim check. This mapping is called one-to-one into mapping. The terminology one-to-one into mapping of a set X and a set Y is well defined and is well known in mathematics. The term means that there is an mapping from each element in X to exactly one element in Y. In the preferred embodiment 2, when the passenger places the claim tag(s) in the field of view of the scanner and the body of scanners scan the baggages on the conveyor belt and compose the identifiers and output them to the comparator, the comparator determines if there is a one-to-one into mapping between the set of claim tag identifiers and the set of baggage tag identifiers.

It should be observed that the term scanning may refer to optical as well as magnetic scanning.

From a reading of the description above of the preferred embodiment of the present invention, modifications and variations thereto may occur to those skilled in the art. Therefore, the scope of the present invention is to be limited by the claims below.

What is claimed is:

1. A method of controlling removal of baggage from a secured area comprising:

scanning a first set of countable encoded tags to obtain a first set of tag identifiers associated with baggage claim checks;

scanning a second set of countable encoded tags to obtain a second set of tag identifiers associated with tags on baggages;

comparing said first and second set of tag identifiers and providing a signal if said first set of tag identifiers can be mapped one-to-one into said second set of tag identifiers, whereby baggage is removable from a secured area in response to said signal.

2. The method of claim 1 further comprising providing a visual indicator proximate to an exit point responsive to said signal, wherein said signal activates said visual indicator.

3. The method of claim 1 further comprising:

providing an abnormal signal if said first set of tag identifiers can not be mapped one-to-one into said second set of tag identifiers; and providing an alarm proximate to an exit point responsive to said abnormal signal, wherein said abnormal signal activates said alarm.

4. The method of claim 1, further comprising moving baggage with baggage tags on a conveyor past a second scanner for obtaining said second set of tag identifiers.

5. An apparatus for controlling removal of baggage from a secured area, comprising:

at least one scanner for scanning a first set of countable encoded tags associated with baggage claim checks to obtain a first set of tag identifiers and scanning a second set of countable encoded tags associated with tags on baggage to obtain a second set of tag identifiers;

means for comparing said first and second set of tag identifiers and providing an authorization signal if said first set of tag identifiers can be mapped one-to-one into said second set of tag identifiers; and exit control means for controlling human and baggage exits responsive to said authorization signal, whereby baggage is removable from a secured area in response to said authorization signal.

6. The apparatus of claim 5 further comprising:

a visual indicator proximate to said human and baggage exits responsive to said authorization signal, wherein said authorization signal activates said visual indicator.

7. The apparatus of claim 5, wherein said comparison means provides an abnormal signal if said first set of tag identifiers can not be mapped one-to-one into said second set of tag identifiers;

and further comprising an alarm proximate to said human and baggages exits responsive to said abnormal signal, wherein said abnormal signal activates said alarm.

8. The apparatus of claim 7 further comprising:

an assistance exit for humans and baggages;

assistance exit control means responsive to said abnormal signal, whereby said assistance exit permits humans and baggages to exit to an area where an agent provides assistance.

9. The apparatus of claim 5, further comprising:

a second scanner for scanning said second set of tag identifiers; and a conveyor for transporting baggage past said second scanner.

10. A method of controlling removal of baggage from a secured area, comprising the steps of:

(a) scanning an encoded baggage claim check to obtain a first set of tag identifiers;

(b) scanning a tag associated with baggage to obtain a second set of tag identifiers;

(c) comparing said first and second set of tag identifiers; and (d) providing a signal if said first set of tag identifiers can be mapped one-to-one into said second set of tag identifiers, whereby said baggage is removable from a secured area in response to said signal.

11. The method as recited in claim 10, further comprising the step of (e) providing a visual indicator proximate to an exit point responsive to said signal, wherein said signal activates said visual indicator.

12. The method as recited in claim 10, further comprising the steps of:

(e) providing an abnormal signal if said first set of tag identifiers can not be mapped one-to-one into said second set of tag identifiers; and (f) providing an alarm proximate to an exit point responsive to said abnormal signal, wherein said abnormal signal activates said alarm.

13. The method as recited in claim 10, further comprising the step of (e) moving baggage with baggage tags on a conveyor past a second scanner for obtaining said second set of tag identifiers.

14. An apparatus for controlling removal of baggage from a secured area, comprising:

at least one scanner for scanning an encoded baggage claim check associated with baggage to obtain a first set of tag identifiers and scanning an encoded tag associated with said baggage to obtain a second set of tag identifiers;

means for comparing said first and second set of tag identifiers;

means for providing an authorization signal if said first set of tag identifiers can be mapped one-to-one into said second set of tag identifiers; and exit control means for controlling human and baggage exits responsive to said authorization signal, whereby baggage is removable from a secured area in response to said authorization signal.

15. The apparatus as recited in claim 14, further comprising a visual indicator proximate to said human and baggage exits responsive to said authorization signal, whereby said authorization signal activates said visual indicator.

16. The apparatus as recited in claim 14, wherein said comparison means provides an abnormal signal if said first set of tag identifiers can not be mapped one-to-one into said second set of tag identifiers;

and further comprising an alarm proximate to said human and baggages exits responsive to said abnormal signal, wherein said abnormal signal activates said alarm.

17. The apparatus as recited in claim 16, further comprising:

an assistance exit for humans and baggages;

assistance exit control means responsive to said abnormal signal, whereby said assistance exit permits humans and baggages to exit to an area where an agent provides assistance.

18. The apparatus as recited in claim 14, further comprising:

a second scanner for scanning said encoded tag associated with said baggage to obtain said second set of tag identifiers; and a conveyor for transporting said baggage past said second scanner.

* * * * *